US010332431B2

(12) United States Patent
Ige

(10) Patent No.: US 10,332,431 B2
(45) Date of Patent: Jun. 25, 2019

(54) LIGHTING LABEL

(71) Applicant: LF Beauty (Shenzhen) Limited, Shenzhen (CN)

(72) Inventor: Leighton Makoto Ige, Hong Kong (HK)

( * ) Notice: Subject to any disclaimer, the term of this patent is extended or adjusted under 35 U.S.C. 154(b) by 0 days.

(21) Appl. No.: 16/200,664

(22) Filed: Nov. 27, 2018

(65) Prior Publication Data

US 2019/0164459 A1 May 30, 2019

(30) Foreign Application Priority Data

Nov. 28, 2017 (CN) ..... 2017 2 1619171 U

(51) Int. Cl.
*F21V 31/00* (2006.01)
*G09F 13/22* (2006.01)

(52) U.S. Cl.
CPC ..... *G09F 13/22* (2013.01); *F21V 31/005* (2013.01); *G09F 2013/222* (2013.01)

(58) Field of Classification Search
CPC ... G09F 13/22; G09F 2013/222; F21V 31/005
See application file for complete search history.

(56) References Cited

U.S. PATENT DOCUMENTS

2009/0027213 A1* 1/2009 Debord ..... G01K 3/005 340/588

FOREIGN PATENT DOCUMENTS

| | | | | |
|---|---|---|---|---|
| CN | 1584957 | | 2/2005 | |
| CN | 201479498 | | 5/2010 | |
| CN | 102483195 | | 5/2012 | |
| CN | 202584649 | | 12/2012 | |
| CN | 102881236 | | 1/2013 | |
| CN | 204688608 | | 10/2015 | |
| CN | 107025857 | | 8/2017 | |
| CN | 206864122 | | 1/2018 | |
| CN | 207624315 | | 7/2018 | |
| FR | 2962840 | | 1/2012 | |
| FR | 2962840 | A1 * | 1/2012 | ..... G09F 3/10 |
| FR | 2994292 | A1 * | 2/2014 | ..... G09F 9/30 |
| FR | 2997218 | A1 * | 4/2014 | ..... G09F 9/30 |

* cited by examiner

*Primary Examiner* — Mary Ellen Bowman

(74) *Attorney, Agent, or Firm* — Eagle IP Limited; Jacqueline C. Lui

(57) ABSTRACT

A lighting label that adheres on a curved surface of a container. The lighting label includes a translucent layer, an illuminating layer, a flexible printed circuit and a waterproof sealant. The illuminating layer includes a plurality of light emitting diodes (LEDs) and a light guide panel. The light guide panel connects to the LEDs and includes dots that scatter the light generated from the LEDs. The waterproof sealant seals an edge of the lighting label and is transparent to illuminate with the light around the edge of the lighting label.

10 Claims, 7 Drawing Sheets

LIGHTING LABEL

FIELD OF THE INVENTION

The present invention relates to a lighting label that illuminates using a plurality of light emitting diodes (LEDs) as a light source and adheres to a curved surface of a container.

BACKGROUND

A product's label and packaging are the first things a potential customer sees when viewing items. A lighting label increases the visual appeal of the product with a sophisticated and luxurious appearance. Also, a lighting label gives better contrast to the product label that makes it easily distinguishable. Methods and apparatus that assist in advancing technological needs and industrial applications in providing a lighting label are desirable.

SUMMARY OF THE INVENTION

One example embodiment is a lighting label that adheres on a curved surface of a container. The lighting label includes a translucent layer, an illuminating layer, a flexible printed circuit (FPC) and a waterproof sealant that seals an edge of the lighting label. The translucent layer diffuses light and has a curved surface that matches the curved surface of the container. The illuminating layer has a shape of the translucent layer and includes a plurality of light emitting diodes (LEDs) and a light guide panel. The LEDs are located at a bottom periphery of the illuminating layer. The light guide panel connects to the LEDs and includes dots that scatter the light generated from the LEDs. The FPC includes an end that connects to the LEDs and has a shape matches the bottom periphery of the illuminating layer. The waterproof sealant is transparent to illuminate with the light around the edge of the lighting label. A front side of the illuminating layer and the end of the FPC adhere to a back side of the translucent layer.

Other example embodiments are discussed herein.

DETAILED DESCRIPTION

Figure 1:
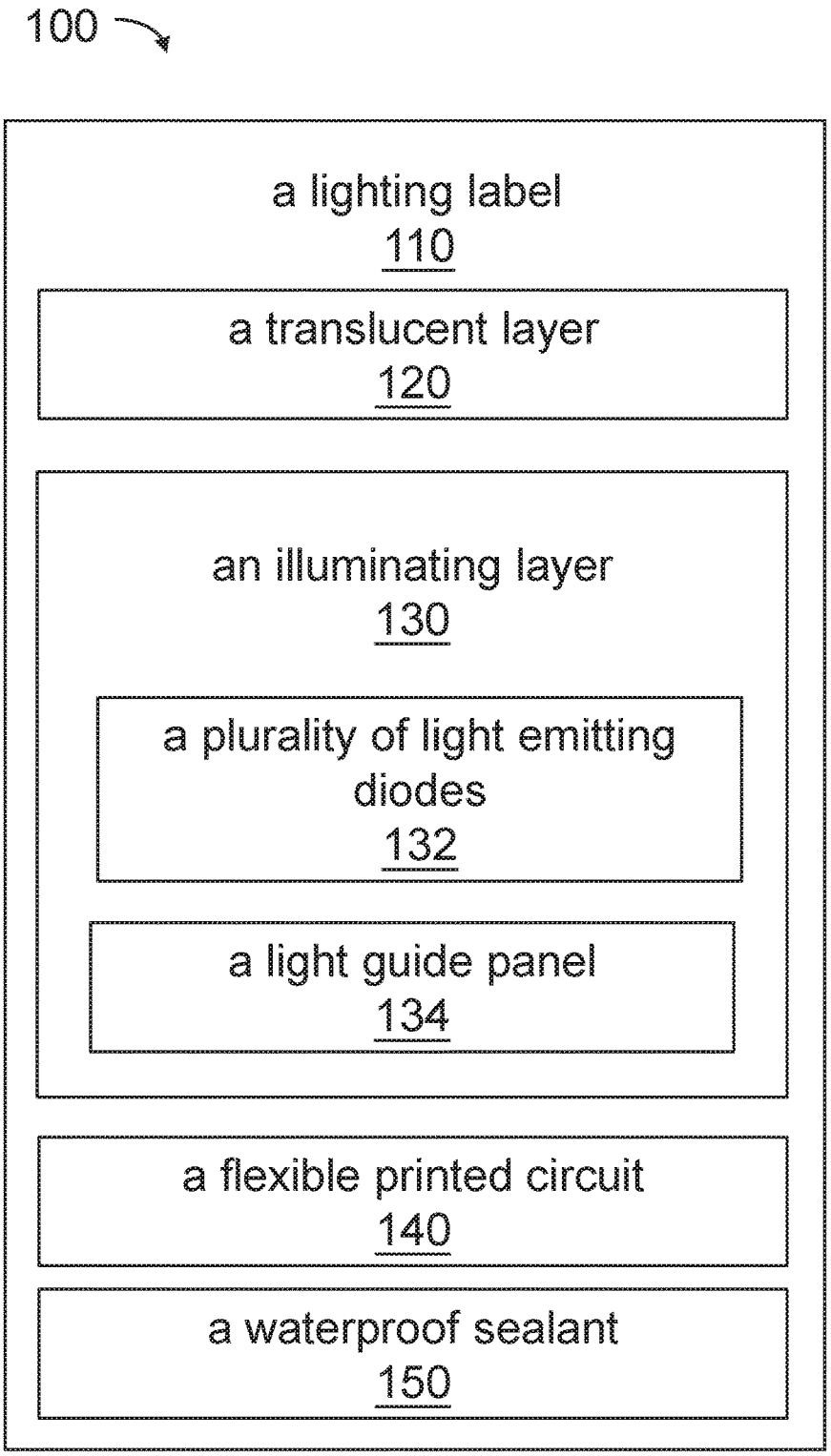
FIG. 1 shows a block diagram for a lighting label in accordance with an example embodiment.

Example embodiments relate to a lighting label that adheres on a curved surface of a container.

In a dark environment, for example, a dimly lit restaurant or club, it is difficult to read a label of a container or a bottle. A lighting label facilitates the user to recognize the brand, logo or the information of the product.

In addition, labelling plays a vital role in the sale of a product and adds aesthetic value to the product itself. A lighting label is eye-catching that attracts customers and helps customers to differentiate the product from others.

Conventional or existing lighting labels use electroluminescent (EL) elements that emit light in response to a passage of an electric current. However, EL elements are limited in the color ranges due to the properties of the material used to manufacture the EL elements. Thus, conventional or existing lighting labels cannot change color. Furthermore, conventional or existing lighting labels have limited lighting effects since EL elements cannot blink rapidly. Also, EL elements suffer from performance degradation over time and so conventional or existing lighting labels are short life. Conventional lighting labels are also not able to have curved shapes that can effectively attach to curved surfaces, such as a curved surface of a bottle. Such lighting labels also have power supplies that are bulky or protrude from the bottle or container and thus provide an impractical or unsightly appearance for the product.

Example embodiments solve the above-stated problems by using light emitting diode (LED) as light source for a lighting label to produce pure monochromatic light of different colors over a curved surface. Thus, unlimited colors are available in the light label. Also, since LED can run with different blinking patterns and lighting modes by implementing switches in designed circuit that communicates with electronic devices, the lighting label can have different lighting effects, such as strobing, flashing, fade in and fade out according to user's needs.

Example embodiments provide a lighting label that is not easily affected by environmental temperature and humidity changes. The Lighting label is long life and reusable.

Furthermore, example embodiments provide a lighting label formed of multiple layers. These layers enable the lighting label to readily attach to curved surfaces, such as a surface of a bottle or other container. These layers include a flexible or bendable printed circuit to accommodate for curved surfaces.

Further yet, an example embodiment provides a power supply located in a recess or cavity formed in the container, such as locating the power supply in a cavity formed in an end of a bottle, such as a beer bottle, wine bottle, or champagne bottle. As such, the power supply is unobtrusive and does not interfere with a user handling the bottle.

It is technically difficult to have homogenous lighting on a curved surface by scattering light generated from a plurality of light emitting diodes (LEDs) throughout a light guide panel. Example embodiments solve technical difficulties by arranging sizes of dots of a curved light guide panel based on the distance of dots from the plurality of LEDs to produce a highly uniform luminance.

Example embodiments satisfy different needs or desires of users by providing a lighting label that illuminates while affixed to a curved surface of a bottle. The lighting label includes a pattern layer which includes a logo of the bottle and illuminates with light from a surface of the lighting label. The lighting label includes a waterproof sealant that seals an edge of the lighting label and is transparent to illuminate with the light around the edge of the lighting label.

FIG. 1 shows a lighting label 110 that adheres on a curved surface of a container in one or more example embodiments.

The lighting label includes a translucent layer 120, an illuminating layer 130, a flexible printed circuit (FPC) 140 and a waterproof sealant 150. The illuminating layer 130 includes a plurality of light emitting diodes (LEDs) 132 and a light guide panel 134.

By way of example, the translucent layer 120 diffuses light and has a curved surface that matches or approximates the curved surface of the container.

By way of example, the illuminating layer 130 that matches or approximates a shape of the translucent layer 120.

By way of example, the plurality of LEDs 132 are located at a bottom periphery of the illuminating layer 130.

By way of example, the LEDs 132 include but not limited to red green blue (RGB) LEDs, though other types of lights can also be used for example embodiments.

By way of example, the light guide panel 134 connects to the LEDs 132 and includes dots that scatter the light generated from the LEDs 132.

By way of example, the FPC 140 includes an end that connects to the LEDs 132 and has a shape that matches or approximates the bottom periphery of the illuminating layer 130.

By way of example, the waterproof sealant 150 seals an edge of the lighting label 110 and is transparent to illuminate with the light around the edge of the lighting label 110.

By way of example, a front side of the illuminating layer 130 and the end of the FPC 140 adhere to a back side of the translucent layer 120.

Figure 2:
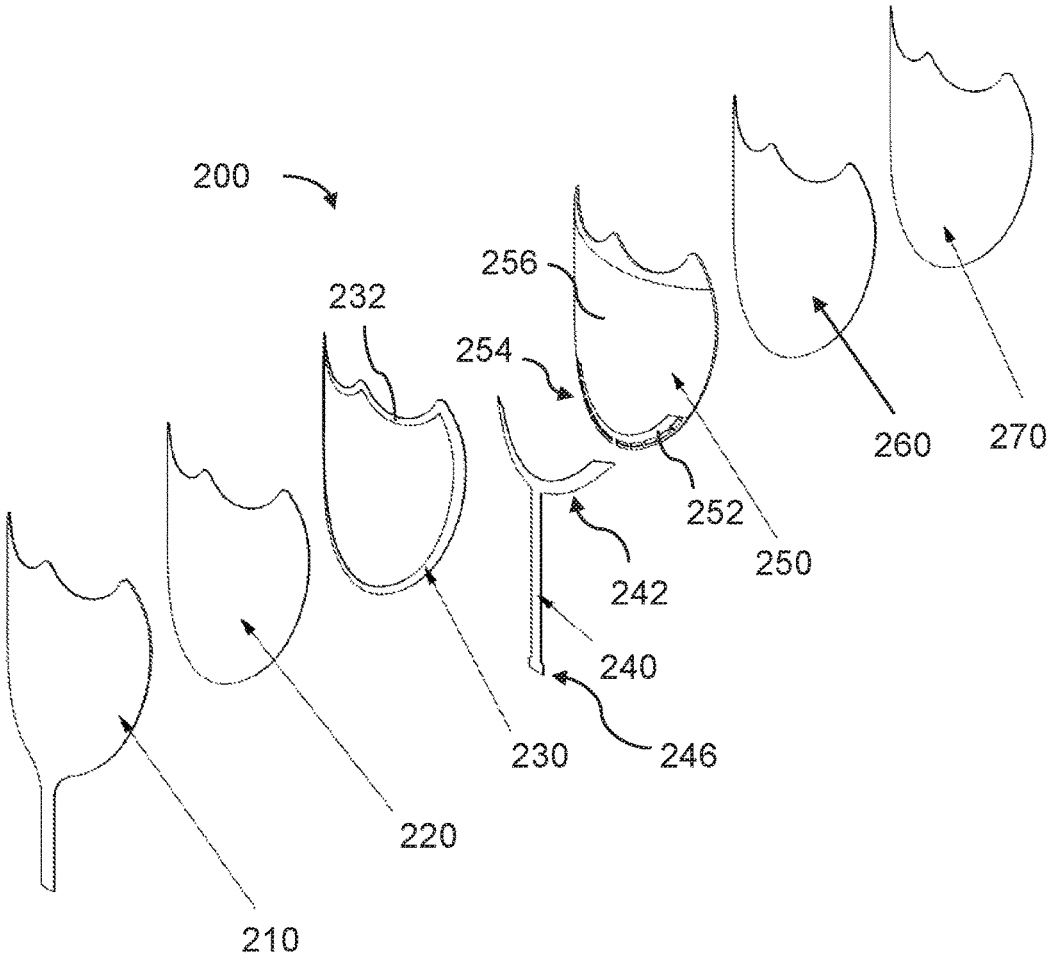
FIG. 2 shows an exploded view of a lighting label in accordance with an example embodiment.

FIG. 2 shows an exploded view of a lighting label 200 that illuminates while affixed to a curved surface of a bottle in one example embodiment.

The lighting label 200 includes a pattern layer 210, a translucent layer 220, a FPC 240, and an illuminating layer 250.

The illuminating layer 250 is formed with a light guide panel 256 and a plurality of LEDs 254. The illuminating layer 250 has a shape of a curved surface that affixes to a curved surface of the bottle.

The plurality of LEDs 254 are arranged on a bottom periphery 252 of the illuminating layer 250.

The FPC 240 has one end 242 connected to the LEDs 254 and another end 246 connected to a power supply that is located in a cavity formed in an end of the bottle (not shown). By way of example, the power supply sits underneath in a cavity or recess in the bottle and is not observable when the bottle stands on a table.

The translucent layer 220 has a shape that matches or approximates the shape of the curved surface of the illuminating layer 250. The translucent layer 220 adheres to a front side of the illuminating layer 250.

The pattern layer 210 has a shape that matches or approximates the shape of the curved surface of the illuminating layer 250. The pattern layer 210 adheres to a front side of the translucent layer 220 such that the translucent layer 220 is sandwiched between the illuminating layer 250 and the pattern layer 210. The pattern layer 210 includes a logo of the bottle and illuminates with light from the LEDs 254.

By way of example, a first adhesive layer 230 is disposed between the translucent layer 220 and the illuminating layer 250 to affix the translucent layer 220 to the illuminating layer 250. By way of example, a second adhesive layer 260 is disposed between the illuminating layer 250 and the surface of the bottle to affix the illuminating layer 260 to the bottle.

By way of example, the first adhesive layer 230 and the second adhesive layer 260 are double sided tape.

By way of example, the first adhesive layer 230 is adhesive only around the periphery 232 of the first adhesive layer 230.

By way of example, the translucent layer 220 is made of Polyethylene terephthalate (PET).

By way of example, the illuminating layer 250, the translucent layer 220, and the pattern layer 210 have a shape of a shield and affix to a surface of a champagne bottle.

By way of example, the pattern layer 210, the translucent layer 220, the first adhesive layer 203, the light guide panel 250, the second adhesive layer and a release paper 270 have the same or similar shape. By way of example, the one end 242 of the FPC 240 has the same shape of the bottom periphery 252 of the illuminating layer 250. All the layers of the lighting label 200 are aligned such that an edge around the periphery of the lighting label 200 is flat and does not have protrusion of any layer. This example embodiment is advantageous since a sealant seals the edge of the lighting label 200 in a line with minimum amount of the sealant that can prevent entry of moisture or water and can allow uniform brightness of light passing through the line of the sealant. By way of example, the sealant is waterproof and transparent.

Figure 3:
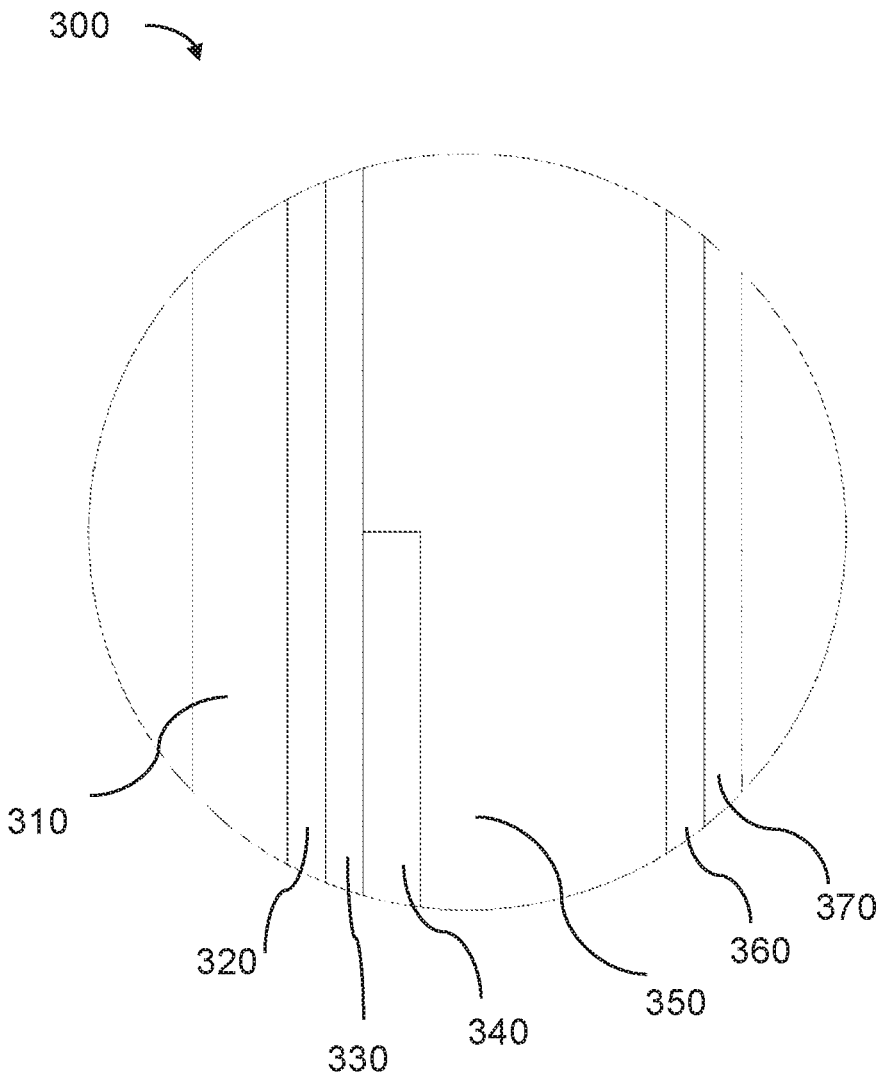
FIG. 3 shows a section view of a lighting label in accordance with an example embodiment.

FIG. 3 shows a section view of a lighting label 300 that adheres on a curved surface of a container in one example embodiment. The lighting label 300 includes a pattern layer 310, a translucent layer 320 and an illuminating layer 350. A front side of the illuminating layer 350 and an end 340 of a FPC adhere to the translucent layer 320 via a first double side tape 330. A back side of the illuminating layer 350 adheres to a second double side tape 360 for adhering on a release paper layer 370 or the curved surface of the container.

Figure 4A:
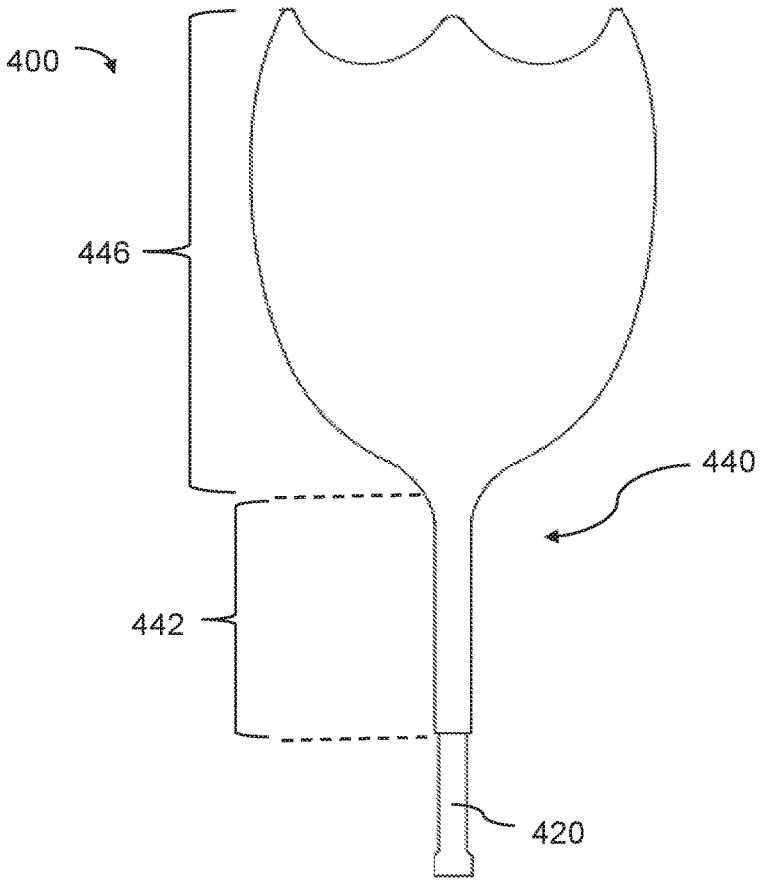
FIG. 4A shows a front view of a lighting label in accordance with an example embodiment.

FIG. 4A shows a front view of a lighting label 400 that adheres on a curved surface of a container in one example embodiment. The lighting label 400 includes a pattern layer 440. The pattern layer 440 is waterproof and has one side disposed on an outside of the container and a second side abutting against a translucent layer and a non-exposure portion of a FPC 420 of the lighting label 400. The pattern layer 440 includes an opaque area (not shown) and a transparent area (not shown) that show a logo of a container. The opaque area does not allow light to pass through and the transparent area allows light to pass through. The pattern layer 440 has a shape that matches or approximates a shape of a translucent layer 446 and a shape of a non-exposure portion 442 of the FPC 420.

By way of example, the length of the shape of a translucent layer 446 is around 94 mm. By way of example, the width of the shape of a translucent layer 446 is around 72.9 mm. By way of example, the length of the shape of the non-exposure portion 442 of the FPC 420 is around 52.6 mm. By way of example, a boundary of the shape of a translucent layer 446 illuminates with light scattered by a light guide panel of the lighting label 400 such that when the container stands on a table, a discontinuous luminance at a bottom periphery where a plurality of LEDs are located is not observable.

Figure 4B:
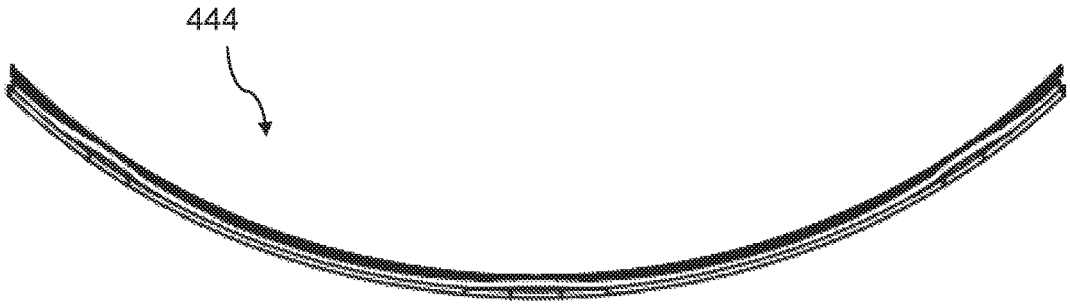
FIG. 4B shows a top view of a lighting label in accordance with an example embodiment.

FIG. 4B shows a top view of a lighting label 444 in one example embodiment. The lighting label 444 includes different layers which has different thickness and flatness but are aligned to have a flat surface on the edge of the lighting label 444. The lighting label 444 includes a waterproof sealant (not shown) that seals an edge of the lighting label 444 to block the passage of fluids (e.g. water) through the surfaces of the layers. By way of example, the waterproof sealant is silicone. The lighting label 444 includes layers that are made of waterproof materials and are unaffected by extremes of temperature. By way of example, the lighting label 444 is resistant to temperature of 0° degrees for at least eight hours. By way of example, the lighting label 444 are resistant for normal situation of −5° degrees to 60° degrees. By way of example, a user can remove the lighting label 444 of a bottle and reuse it for another bottle.

Figure 5:
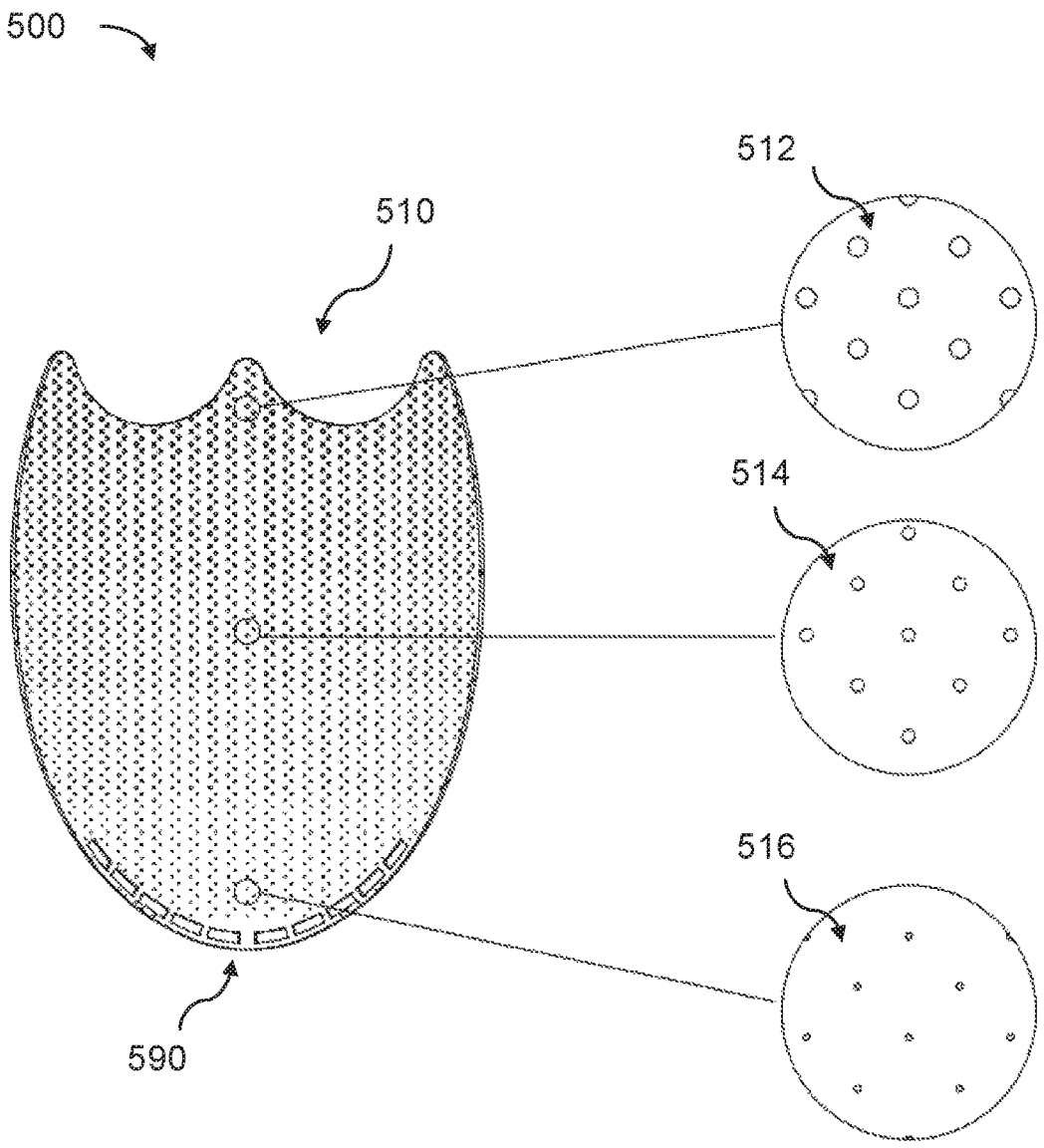
FIG. 5 shows a lighting label in accordance with an example embodiment.

FIG. 5 shows an illuminating layer 500 of a lighting label that adheres on a curved surface of a container and includes partial enlarged views in one example embodiment. The illuminating layer 500 includes a plurality of LEDs 590 that are located at a bottom periphery of the illuminating layer 500, and a light guide panel 510 that connects to the LEDs 590 and includes dots that scatter the light generated from the LEDs 590. The LEDs 590 have different heights with respect to a base of the container. The sizes of the dots of the light guide panel 510 increase with increasing distance from the plurality of LEDs 590 such that a homogeneous brightness of the light is scattered from a surface and an edge of the light guide panel 510.

By way of example, a same or similar brightness of the light is scattered from a surface of the light guide panel 510. By way of example, the dots 512 at one end of the light guide panel 510 furthest from the LEDs 590 have a largest size. By way of example, the dots 516 at one end of the light guide panel 510 closet to the LEDs 590 have a smallest size. By way of example, the dots 514 that are located between the dots 512 and the dots 516 of the light guide panel 510 have a size between the largest size and the smallest size.

Figure 6:
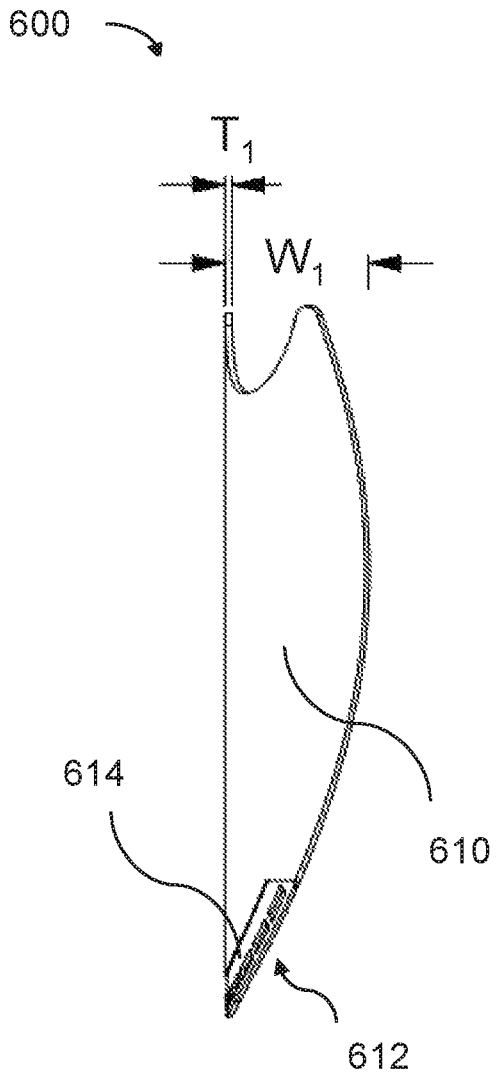
FIG. 6 shows a light guide panel of a lighting label in accordance with an example embodiment.

FIG. 6 shows a light guide panel 600 of a lighting label in one example embodiment. By way of example, the light guide panel 600 has a plurality of cuts 612 at a bottom periphery 614 of an illuminating layer of the lighting label to accommodate a plurality of LEDs. By way of example, the plurality of LEDs are arranged on the FPC before assembly of the lighting label and the LEDs are press molded to connect with the light guide panel 600 to form the illuminating layer. By way of example, a width of curvature $W_1$ of the light guide panel 600 is greater than 18 mm. By way of example, $W_1$ of the light guide panel 600 is around 18.44 mm. By way of example, a thickness $T_1$ of the light guide panel 600 is not greater than 1 mm. By way of example, $T_1$ of the light guide panel 600 is around 0.80 mm.

Figure 7A:
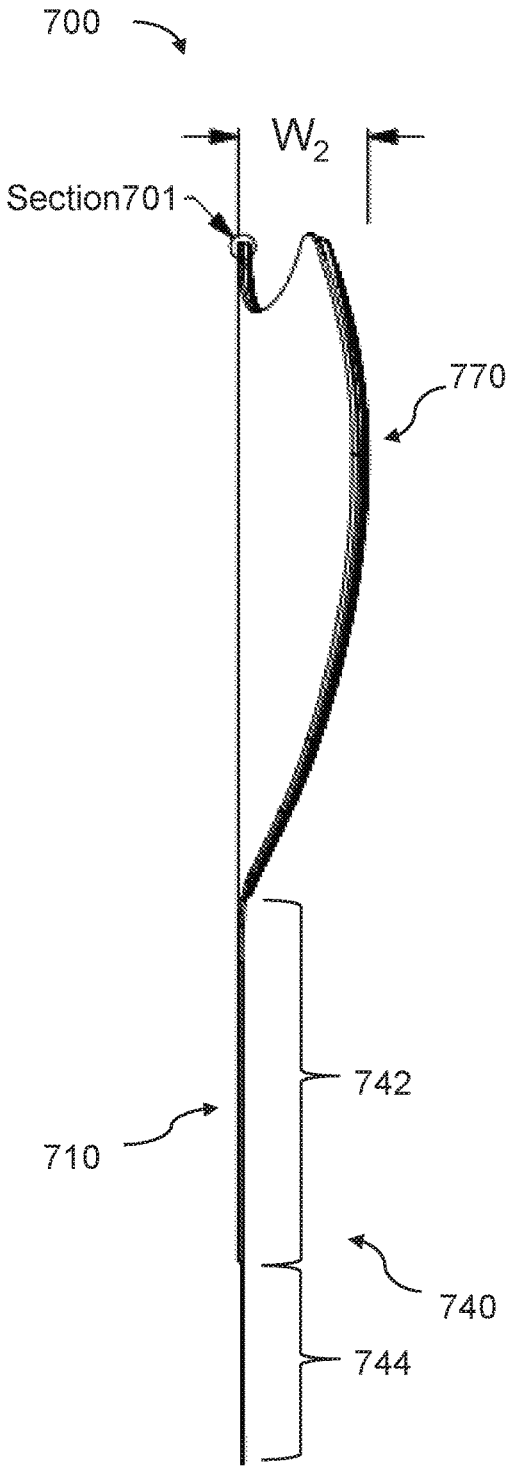
FIG. 7A shows a side view of a lighting label in accordance with an example embodiment.

FIG. 7A shows a side view of a lighting label 700 that illuminates while affixed to a curved surface of a bottle in one example embodiment. The lighting label 700 includes a pattern layer 710 at a front side of the lighting label 700 and a release paper layer 770 at a back side of the lighting label 700. The lighting label 700 also includes a FPC 740 that has one end connected to a plurality of LEDs and another end connected to a power supply that is located in a cavity formed in an end of the bottle. The FPC 740 includes an exposure portion 744 that has one side disposed on an outside of a curved surface of a bottle and a non-exposure portion 742 that has one side abutting against the pattern layer 710. By way of example, a length of the non-exposure portion 742 is around 28.8 mm. By way of example, a width of curvature $W_2$ of the lighting label 700 is greater than 18 mm. By way of example, a width of curvature $W_2$ of the lighting label 700 is around 18.4 mm.

Figure 7B:
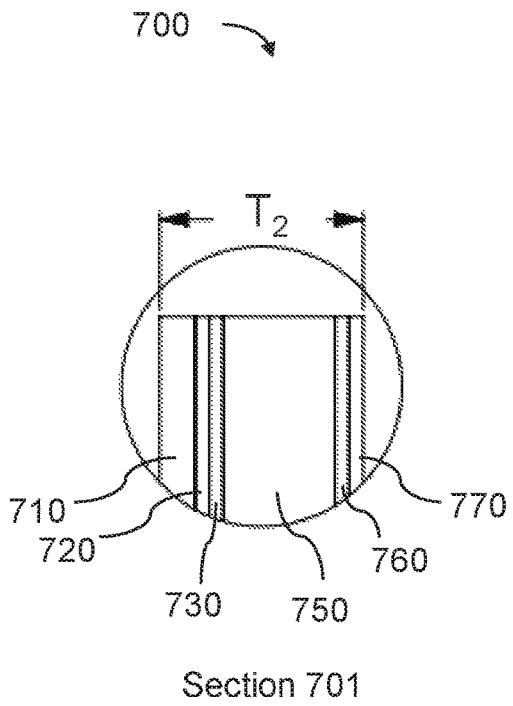
FIG. 7B shows a partial enlarged view of the lighting label in accordance with an example embodiment in FIG. 7A.

FIG. 7B shows a partial enlarged view 701 of the lighting label 700 shown in FIG. 7A. The lighting label 700 includes six different layers that include a pattern layer 710 having one side disposed on an outside of the bottle and a second side abutting against a translucent layer 720, the translucent layer 720, a first adhesive layer 730 disposed between the translucent layer 720 and an illuminating layer 750, the illuminating layer 750, a second adhesive layer 760 disposed between the illuminating layer 750 and a release paper layer 770, the release paper layer 770. By way of example, the thickness $T_2$ of the lighting label 700 is not greater than 1.5 mm. By way of example, the thickness $T_2$ of the lighting label is around 1.45 mm. The release paper layer 770 protects a back side of the second adhesive layer 760. By way of example, the release paper layer 770 is a paper or plastic-based film sheet used to prevent the back side of the second adhesive layer 760 from prematurely adhering. To affix the lighting label 700 to the curved surface of the bottle, the release paper layer 770 is removed and the back side of the second adhesive layer 760 is affixed to the curved surface of the bottle.

As used herein, "flexible printed circuit" and "FPC" is conductive wires bonded on a flexible substrate that carries electrical signal.

As used herein, "container" and "bottle" is interchangeable and is a receptacle that has a curved surface for holding, storing and transporting objects or materials, such as liquids. Examples of a bottle include, but are not limited to, beer bottles, wine bottles, champagne bottles, and other bottles that carry liquids for consumer consumption or use.

As used herein, "light guide panel" is an area on which a matrix of dots are protruded from the light guide panel from molding on the same piece and used to distribute light from a light source over an entire surface of the area. By way of example, the light guide panel is made of PET or equivalent.

The lighting label in accordance with example embodiments are provided as examples, and examples of one lighting label should not be construed to limit examples from another lighting label. Further, the lighting label discussed within different figures can be added to or exchanged with configurations in other figures. Further yet, specific numerical data values (such as specific quantities, numbers, categories, etc.) or other specific information should be interpreted as illustrative for discussing example embodiments. Such specific information is not provided to limit example embodiments.

What is claimed is:

1. A lighting label that adheres on a curved surface of a container, comprising:

a translucent layer that diffuses light and that has a curved surface that matches the curved surface of the container;

an illuminating layer that has a shape of the translucent layer, the illuminating layer includes:

a plurality of light emitting diodes (LEDs) that are located at a bottom periphery of the illuminating layer;

a light guide panel that connects to the LEDs and includes dots that scatter the light generated from the LEDs;

a flexible printed circuit (FPC) that includes an end that connects to the LEDs and has a shape that matches the bottom periphery of the illuminating layer; and a waterproof sealant that seals an edge of the lighting label, wherein the waterproof sealant is transparent to illuminate with the light around the edge of the lighting label, wherein a front side of the illuminating layer and the end of the FPC adhere to a back side of the translucent layer.

2. The lighting label of claim 1 further comprising:

a pattern layer that includes an opaque area and a transparent area, wherein the pattern layer has a shape that matches the shape of the translucent layer and a shape of a non-exposure portion of the FPC, wherein the pattern layer is waterproof and has one side disposed on an outside of the container and a second side abutting against the translucent layer and the non-exposure portion of the FPC.

3. The lighting label of claim 1, wherein the front side of the illuminating layer and the end of the FPC adhere to the translucent layer via a first double side tape, wherein a back side of the illuminating layer adheres to a second double side tape for adhering on the curved surface of the container.

4. The lighting label of claim 1, wherein the plurality of LEDs have different heights with respect to a base of the container, wherein sizes of the dots of the light guide panel increase with increasing distance from the plurality of LEDs such that a same brightness of the light is scattered from a surface of the light guide panel.

5. The lighting label of claim 1, wherein a thickness of the lighting label is not greater than 1.5 mm, and a width of curvature of the lighting label is greater than 18 mm.

6. A lighting label that illuminates while affixed to a curved surface of a bottle, the lighting label, comprising:

an illuminating layer formed with a light guide panel and a plurality of light emitting diodes (LEDs), wherein the illuminating layer has a shape of a curved surface that affixes to a curved surface of the bottle, and the plurality of LEDs are arranged on a bottom periphery of the illuminating layer;

a flexible printed circuit (FPC) that has one end connected to the LEDs and another end connected to a power supply that is located in a cavity formed in an end of the bottle;

a translucent layer that adheres to a front side of the illuminating layer; and a pattern layer adheres to a front side of the translucent layer such that the translucent layer is sandwiched between the illuminating layer and the pattern layer, wherein the pattern layer includes a logo of the bottle and illuminates with light from the LEDs.

7. The lighting label of claim 6, wherein the translucent layer and the pattern layer have the shape of the curved surface of the illuminating layer which is a shape of a shield and the lighting label affixes to a surface of a champagne bottle.

8. The lighting label of claim 6 further comprising:

a first adhesive layer disposed between the translucent layer and the illuminating layer to affix the translucent layer to the illuminating layer; and a second adhesive layer disposed between the illuminating layer and the surface of the bottle to affix the illuminating layer to the bottle, wherein the first adhesive layer and the second adhesive layer are double sided tape.

9. The lighting label of claim 6 comprising six different layers that include a release paper layer, the illuminating layer, a second adhesive layer disposed between the release paper layer and the illuminating layer, the translucent layer, a first adhesive layer disposed between the translucent layer and the illuminating layer, and the pattern layer having one side disposed on an outside of the bottle and a second side abutting against the translucent layer.

10. The lighting label of claim 6, wherein the lighting label is resistant to temperature of 0° C. degrees for at least eight hours and is waterproof.

* * * * *